US006570087B2

(12) United States Patent
Navone et al.

(10) Patent No.: US 6,570,087 B2
(45) Date of Patent: May 27, 2003

(54) DELTA MAGNETIC DE-FLUXING FOR LOW NOISE SIGNAL CABLES

(75) Inventors: David Navone, Stockton, CA (US); Richard L. Clark, Burlington, NC (US)

(73) Assignee: AutoSound 2000, Inc., Stockton, CA (US)

( * ) Notice: Subject to any disclaimer, the term of this patent is extended or adjusted under 35 U.S.C. 154(b) by 0 days.

(21) Appl. No.: 09/785,564

(22) Filed: Feb. 16, 2001

(65) Prior Publication Data

US 2001/0047874 A1 Dec. 6, 2001

Related U.S. Application Data

(60) Provisional application No. 60/136,195, filed on May 25, 1999, and provisional application No. 60/183,665, filed on Feb. 18, 2000.

(51) Int. Cl.[7] ..... H01B 7/34
(52) U.S. Cl. ..... 174/36; 174/28
(58) Field of Search ..... 174/36, 27, 28, 174/110 R, 113 R, 113 C, 111; 333/1, 12, 442

(56) References Cited

U.S. PATENT DOCUMENTS 680,150 A * 8/1901 Hultman ..... 174/111
2,932,805 A * 4/1960 Doherty ..... 333/12
4,506,235 A * 3/1985 Mayer ..... 333/12
4,539,433 A * 9/1985 Ishino et al. ..... 174/35 MS
4,656,451 A * 4/1987 Pomponio ..... 333/12
4,754,102 A * 6/1988 Dzurak ..... 174/36
4,843,356 A * 6/1989 Lusignan et al. ..... 174/105 R
4,885,555 A * 12/1989 Palmer ..... 333/12
4,920,233 A * 4/1990 Kincaid ..... 174/36
5,010,210 A * 4/1991 Sidi et al. ..... 174/34
5,033,091 A * 7/1991 Bond ..... 381/94
5,200,730 A * 4/1993 Masuda et al. ..... 333/12
5,287,074 A * 2/1994 Meguro et al. ..... 333/12
5,510,578 A * 4/1996 Dunlavy ..... 174/128.1
5,548,082 A * 8/1996 Palmer ..... 174/34
5,594,397 A * 1/1997 Uchikoba et al. ..... 333/202
5,763,825 A * 6/1998 Gilliland ..... 174/36
5,767,441 A * 6/1998 Brorein et al. ..... 174/27
5,814,768 A * 9/1998 Wessels et al. ..... 174/110 FC
5,880,402 A * 3/1999 Nugent ..... 174/27

* cited by examiner

*Primary Examiner*—Chau N. Nguyen
*Assistant Examiner*—William H. Mayo, III
(74) *Attorney, Agent, or Firm*—Amster, Rothstein and Ebenstein

(57) ABSTRACT

A cable for conducting electronics signals in proximity to a source of electromagnetic interference, the cable has at least one longitudinally extending conductive wire having a diameter and an outer surface and a spacing member substantially coaxially disposed around the at least one wire and having a diameter and an outer surface, wherein the ratio of the diameters of the spacing member and the wire is about 4:1 and the spacing member contains no EMI shielding constituent.

18 Claims, 11 Drawing Sheets

Old Design With Cables Placed Close to The Noise Source

Possible methods of Navone - Clark's Delta De-Fluxing System

Delta De-Fluxing Design With Cables Extended Away From the Noise Source.

Normal Twisted Pair Signal Cable

Minimum Delta Factor
Cable Design

Delta Factor 7:1
Low Frequency
Inductive Noise
Reduced by 24.85 dB

DELTA MAGNETIC DE-FLUXING FOR LOW NOISE SIGNAL CABLES

This application claims priority under 35 U.S.C. 119(e) based upon the Provisional Application No. 60/136,195 filed May 25, 1999 and No. 60/183,665 filed Feb. 18, 2000.

BACKGROUND OF THE INVENTION

1. Field of the Invention

This invention is in the field of low noise signal cables, particularly audio cables used in a high noise environment such as an automobile or a house equipped with typical appliances and accessories.

2. Description of the Prior Art

As the number of electrical accessories increase, our work, transportation, and living environments are becoming increasingly exposed to unwanted noise. In many situations, the noise from the environment can affect our audio, telephone, or computer by adding noise. This invention describes a new method to reduce the level of noise.

Noisy Listening Environments

In mobile electrical systems, the car's alternator supplies all the energy for the electrical accessories—including the energy to recharge the battery. The car's conductive chassis is used as a ground return for virtually all of these electrical accessories—including the battery. The output of the car's alternator contains AC (alternating current) ripple that is superimposed upon the DC (direct current) that is used to operate the electrical accessories as well as recharge the battery. This AC by-product of the alternator is therefore conducted over the accessory wires, as well as over the car's chassis.

Home and pro-audio environments also experience noise from electrical conduits, light dimmers, as-well as other 50 and 60 Hz AC power and control systems. Computer and telephone systems are also prone to noise from electrical systems.

For car audio and other sensitive automotive electrical systems, the AC flowing on the car's chassis and power distribution system can manifest itself as interference or noise. This means that when the car's electrical accessories (electric mirrors, rear window de-fogger, engine fan, air conditioning system, electric seats, windshield wiper motors, etc.) are activated, the DC component is used to power the accessories, however, AC interference from the alternator flows on the car's chassis as well as the accessory power and control wires.

The nature of this type of interference in the car audio, home audio, pro-audio, computer and telephone systems is low frequency because it lies in the 0 to 100,000 Hz bandwidth. Human hearing is generally accepted to lie in the 20 Hz to 20,000 Hz bandwidth. Therefore, the interference that is concentrated between 20 Hz to 20,000 Hz is particularly bothersome because this interference can be superimposed over the audio.

Low frequency accessory noise is coupled into the audio, telephone, computer, etc., components when their signal, power, and/or control cables are placed within the changing electromagnetic field caused by a changing electromagnetic field. For car audio systems, the changing electromagnetic field extends from the case of the alternator to every point on the car's chassis. Likewise, activating brake light, electric motors, fans, windshield wiper motors, and other accessories can create changing electromagnetic fields. These changing electromagnetic fields extend throughout the accessory power distribution system and control leads as well as over the accessories themselves.

In home, pro-audio, telephone, computer, etc., systems, sources of changing electromagnetic fields are wires, circuits, conduits, and other electrical components.

By a process called induction, a copy of the changing electromagnetic field is induced onto the signal, control and power cables of the audio components. This replica of the changing electromagnetic field is called noise or interference. The interference manifests itself as an audible whining, whirring, popping, or buzzing in the receiving system.

Likewise, the changing electromagnetic field in an accessory circuit can affect sensitive automotive, home, telephone or computer circuits. For instance, the power, control, or signal leads of a car audio component can interfere with control, safety, maintenance, or accessory circuits of the automobile.

For car audio systems, it is common for the deck (i.e., an AM/FM/CD player) to be located in the dash at the front of the car. Other components such as the equalizer(s), electronic crossover(s), processor(s), and amplifier(s) may be located in the console, under seats, on the rear package tray, in the trunk and other places within the vehicle.

The audio bandwidth electrical signal is typically routed from the output of the deck, into the processor(s), the amplifier(s) and finally the loudspeakers. For home, pro-audio, computer, telephone, etc. systems, the components can be separated over great distances.

In all cases, a small AC signal is routed alone a closed loop between the components. Signal cables, phone lines, RCA cables, RCA signal cables, RCA phono cables, parallel conductor cables, co-axial cables, DIN cables, shielded twisted paired cables (STP) and unshielded twisted paired cables (UTP) are used to convey the signal between components. These cables vary in length from a couple of inches up to 20 feet or more. With multi-channel systems, these signal cables carry 2, 3, 4, 5, 6 and more cable pairs.

As seen in FIG. 1, considering an area A placed within a changing magnetic field, the magnetic induction surrounding a wire or current loop inside that field will have closed lines of magnetic induction.

Faraday's law of electromagnetic induction says that an EMF (electro motive force) appears in a circuit whenever there is a change in the magnetic flux through that circuit. The size or magnitude of the EMF is equal to the flux's time rate of change through the circuit. Lenz's law states that the effects of a current associated with an induced EMF oppose the action that is causing the induced EMF.

When two circuits are placed next to each other, and current changes in one of them, the flux associated with the current will also change. An EMF will then be induced in the second circuit. By comparing the coefficients of induction of the two circuits, we arrive at a proportionally constant called the coefficient of mutual induction. This mutual inductance is independent of conductor size and is solely a function of the geometry between the two circuits, see FIG. 2.

Reducing the noise at the source is not practical since it requires modifying the car's electrical circuits or the home's wiring.

Due to the nature of low frequency electromagnetic interference, shielding accessory signal, control, and power cables from low frequency noise is both difficult and expensive. Shielding the source of the changing electromagnetic field is not practical because the car's chassis is one of the largest sources. Likewise, shielding a house or a studio is not practical. Shielding the receiver is also not practical.

Reducing the loop area of the receiving circuit is of benefit, but since the location of the deck (i.e., AM/FM/CD player) is in the car's dash and the components are frequently placed elsewhere, there is a limit to this solution. Also, since the signal, control and power cables are usually manufactured in specific lengths, the loop areas cannot always be minimized.

Changing the relative orientation between the source and the receiving circuits is not practical due to the size of the car's chassis and the availability of cable routing passages and bundles. Also, if the orientation improves for one particular electrical accessory (e.g., the headlights), it may increase the interference when another accessory is activated (e.g., the windshield wiper motors).

Using twisted pair cabling (UTP or STP) in lieu of Delta Factor or parallel pairs on the signal path is of benefit. With twisted pair cabling noise is induced equally onto the two conductors of the closed loop. Any noise picked up in the cable pair can be canceled in the receiving stage. Since it is difficult to maintain shield integrity with STP, the use of UTP is the preferred method of conveying a signal between audio components. When compared to Delta Factor or parallel cables, twisted pair cables have made a significant reduction in the level of noise picked up in receiving systems.

SUMMARY OF THE INVENTION

The present invention provides a new method of further reducing the induced noise picked up by a receiver in a noisy environment. The method reduces the magnetic flux by decreasing the mutual inductance between the source and the receiving circuit. This decrease is accomplished by increasing the distance between the source and the receiving circuit.

By minimizing the size of the conductors, and maximizing the distance between the conductor and the outer edge of the spacer material, we arrive at a factor called Delta, which represents a difference in space. The greater the Delta between the conductor and the outer edge of the surrounding non-conducting material, the less noise will be coupled into the cable.

By using a nonconductive material to physically increase the separation between the signal, control or power cabling of the receiving circuit (i.e., the UTP), and the noise source (i.e., the car's chassis), the interference picked up in the receiving circuit is reduced. The greater the separation between the audio signal cable and the car's chassis, the less noise is picked up in the car audio system, see FIG. 3.

As seen in FIG. 4, as d, the separation distance between the noise source and the receiving circuit, is increased by a factor N, the noise induced into the receiving circuit is decreased. A prior art placement design with cables placed close to the noise source is shown in FIG. 5. The Delta de-fluxing design of the present invention with cables extended away from the noise source is shown in FIGS. 6 and 7.

DETAILED DESCRIPTION OF EMBODIMENTS OF THE INVENTION

Figure 1:
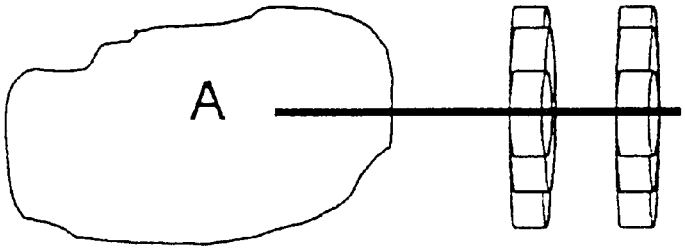
FIG. 1 PRIOR ART
FIG. 1 is diagram illustrating the effects of a field on a conductor.
Figure 2:
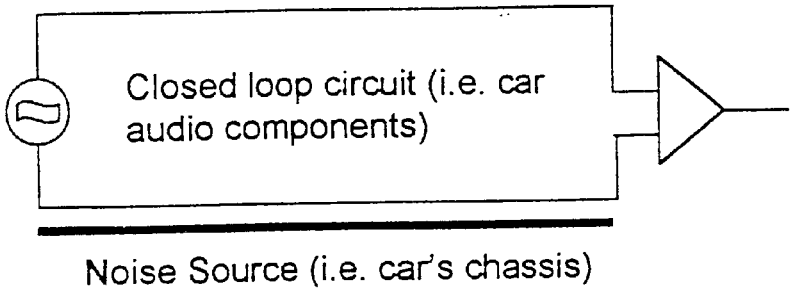
FIG. 2 PRIOR ART
FIG. 2 depicts the effects of a noise source on a closed loop circuit.
Figure 3:
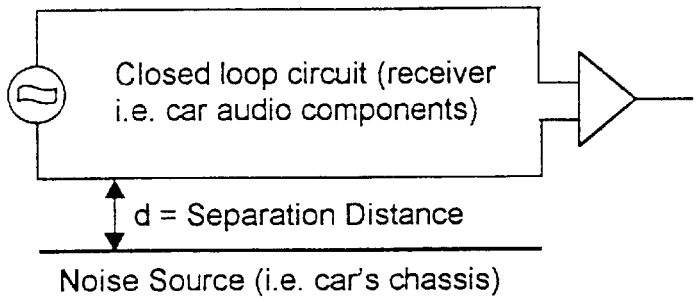
FIG. 3 shows the effect of a separation distance.
Figure 4:
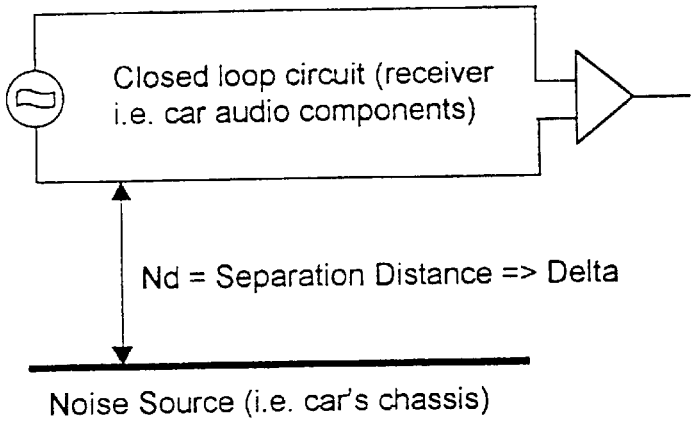
FIG. 4 shows the effect of a separation distance.
Figure 5:
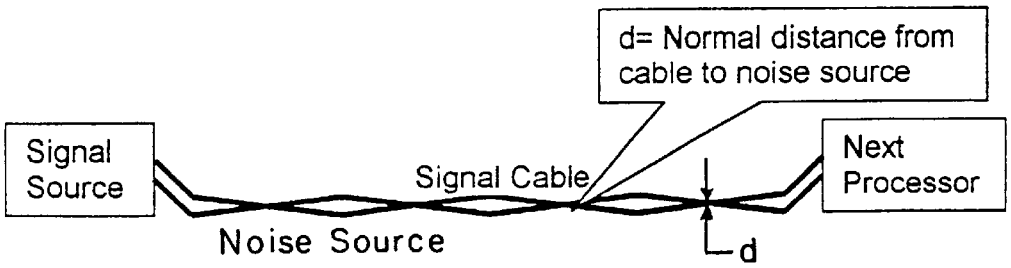
FIG. 5 PRIOR ART
FIG. 5 illustrates a prior art cable placement.
Figure 6:
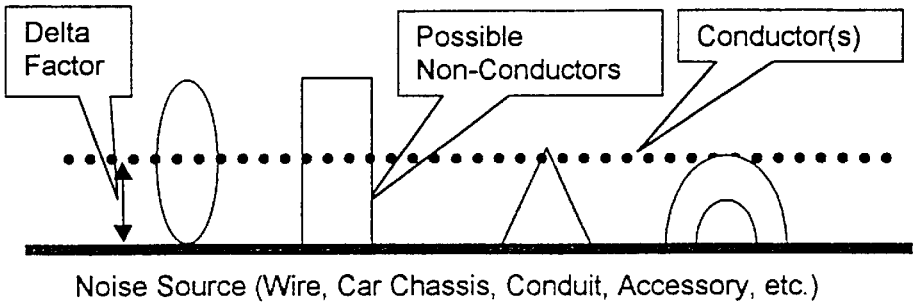
FIGS. 6 and 7 illustrate the placement of cables according to the present invention.
Figure 7:
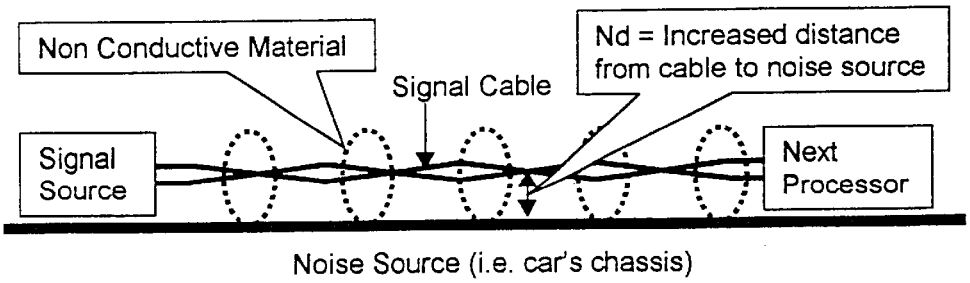
Figure 8:
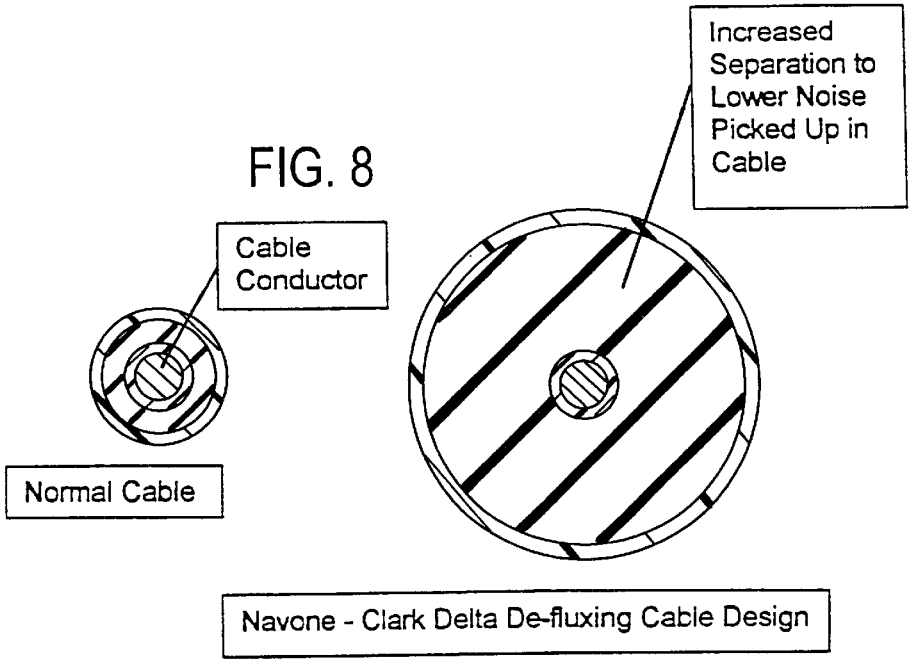
FIG. 8 is a diagram showing the cross section of the cable structure.

The present invention can be manufactured over existing cables or designed into new cables. It can be used with a single conductor or with multiple conductors. The purpose of the present invention is to increase the physical separation between the noise source and the signal cable as shown in FIGS. 6 and 7 using the structure of FIG. 8.

In the development of this invention twisted pair construction techniques were used and the size of the conductors was minimized. The wire size was #28 AWG and comprised of seven strands and was twisted approximately 2 turns per inch. Since the cable stereo, two twisted pairs (four small wires) were necessary, as illustrated in FIG. 9.

Figure 9:
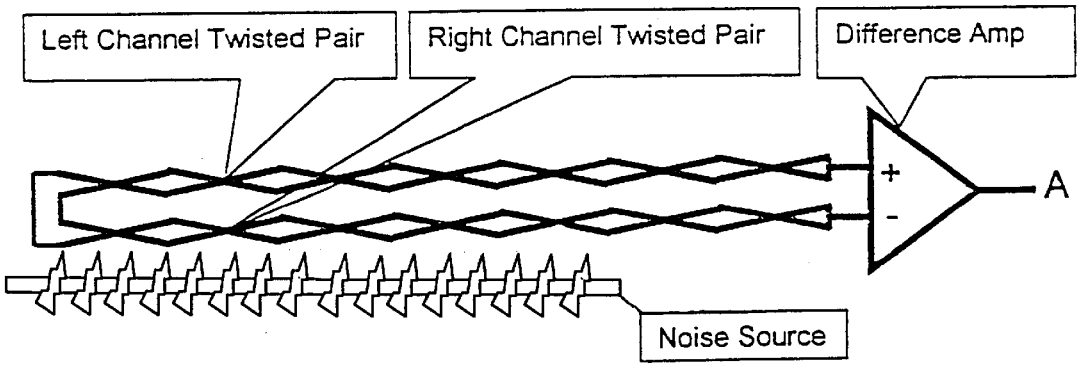
FIG. 9 depicts a twisted pair stereo experimental set-up.

During one experiment using the set-up illustrated in FIG. 9, the difference noise picked up by the left and right stereo pairs of signal cables was measured. This noise can also be called Loop Area interference. As the loop area is increased, more noise was measured at point A. As the loop area is decreased, less noise was measured at point A.

Figure 10:
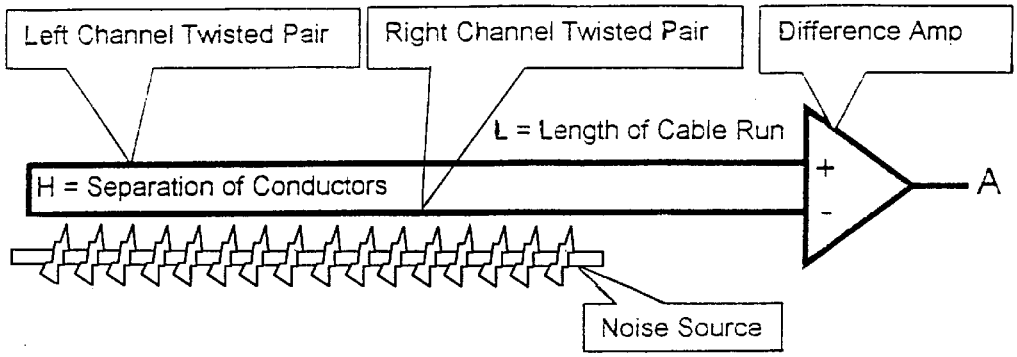
FIGS. 10–13 illustrate a second experimental set-up.
Figure 11:
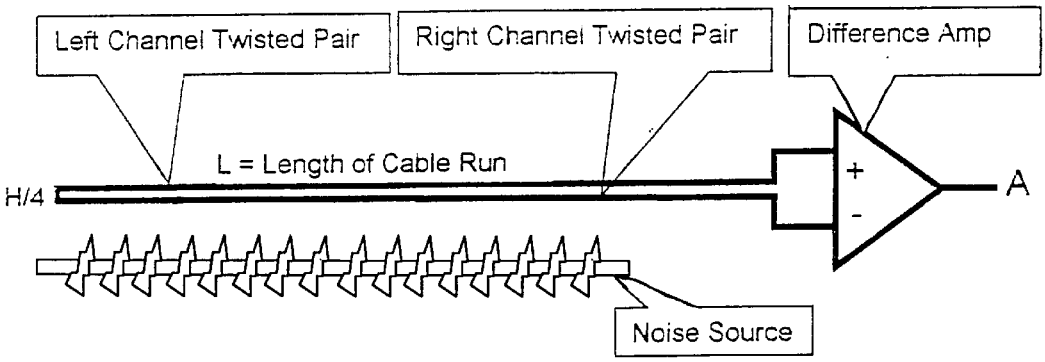
Figure 12:
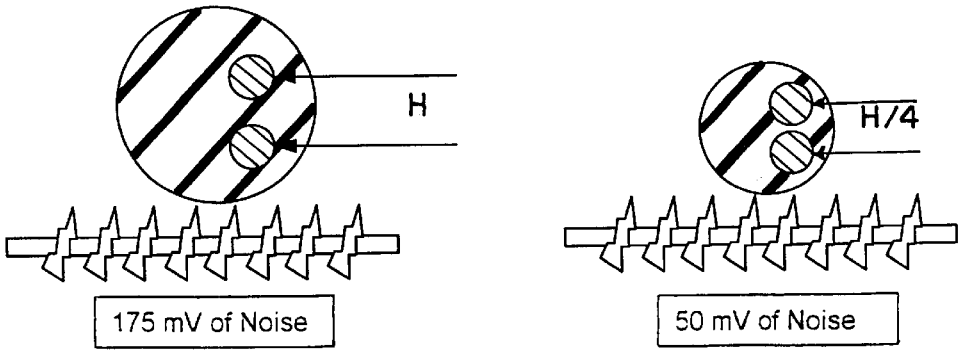

In the experiment shown in FIG. 10, 175 mV of noise was measured at point A. Next, H, the separation of the cable pairs, was reduced to approximately ¼ H as can be seen in FIG. 11. (H was approximately 0.4 inches and H/4=0.1"). This time the noise measured at point A was 50 mV. The smaller the wire loop, the less noise was picked up in the difference amplifier. When viewed from the side down the axis of the cable, the cable configuration is shown in cross section in FIG. 12.

Figure 13:
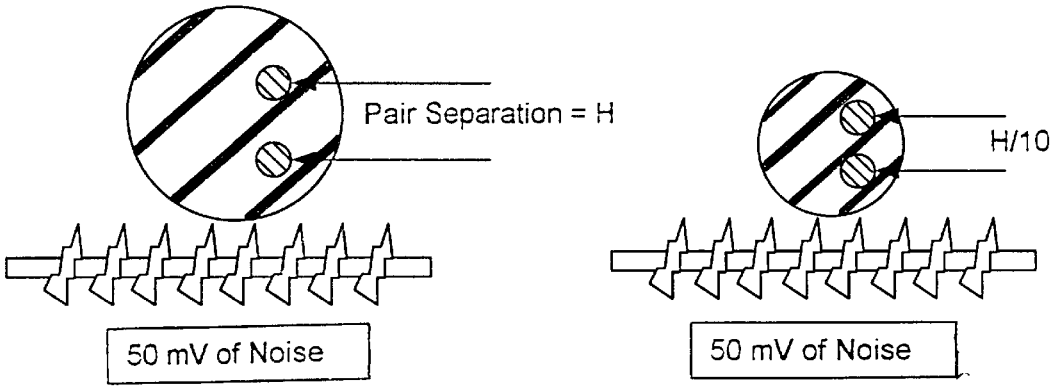

Next, the size of the wire to #38 AWG was further reduced and the spacing between the cable pairs, H was also reduced. These very tiny wires permitted the separation, H, to be approximately H/10. The problem was that although H was greatly reduced, the level of noise picked up in the cable remained the same, around 50 mV, see FIG. 13.

The reason that the noise level was not reduced was that the smaller sized cable was now situated closer to the source of the low frequency noise. The smaller sized cables, and the greatly reduced loop area configuration, did not further reduce the level of noise picked up in the cables. The smaller wire and insulation, was now in closer proximity to the changing electromagnetic field. Low frequency electromagnetic field strength is highest at the source. Therefore, the cables were now experiencing greater noise—even though the design was optimized to pick up minimum noise.

Figure 14:
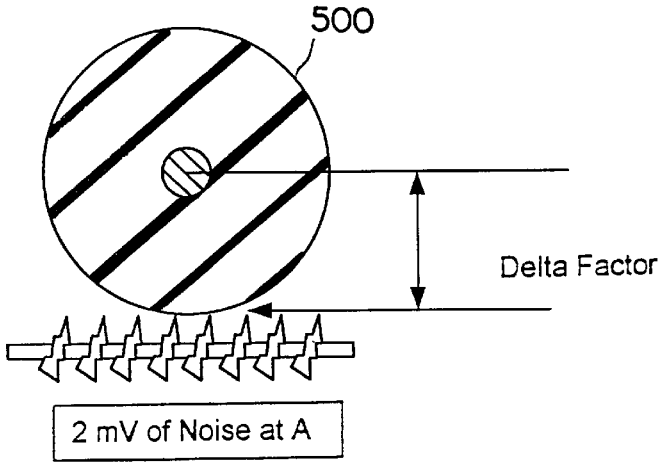
FIG. 14 is a cross sectional view of the spacer and the present invention.

The solution to the problem discovered by the present inventors was to increase the separation of the optimally designed cables from the source of the noise. In the experiment depicted in FIG. 14, the distance between the cable and the source of the noise (Delta Factor) was increased by approximately 0.4 inch. This resulted in a tremendous decrease in noise 2 mV measured at point A.

The material initially used for the spacer 500 was plastic housing. Fiberglass, glass, wood, paper, cloth, air and other gasses, water, etc. have been tested and it has been found that any non-conducting material was suitable for the spacer 500. Different shapes have been tested and it has been found that any shaped material that served to increase the Delta Factor distance between the conductors and the noise was suitable for the spacer 500.

One embodiment of the present invention employs a compressible material (e.g., sponge rubber cord) for the spacer 500. This material has proven very advantageous in that it can be compressed in specific places along the length of the cable (e.g., around corners) without insignificantly compromising the interference reduction properties of the present invention.

Recalling that loop area noise increases with the length of the conductors, it was deduced that longer cable runs were more susceptible to noise. For instance, if the noise picked up by a 3-foot long able is insignificant with a Delta Factor of 0.2", then a longer cable will require a greater Delta Factor to maintain the same level of noise picked up by the cables—all else equal.

Figure 15:
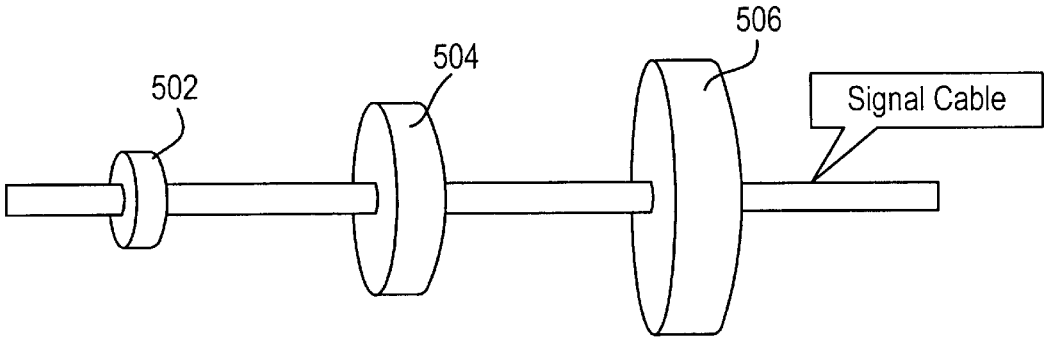
FIG. 15 illustrates three types of spacers.

To test this premise, a large conductive plate of metal was used with an alternator bolted to one end and a load connected to the other end. Various sets of "clip-on" spacers 502, 504, 506 were used, as seen in FIG. 15.

Starting with the low noise spacer 502, co-axial cables, twisted pair cables, parallel conductor cables, etc. were tested. With every type of cable, the spacer 502 reduced the level of noise picked up by the cables. In many instances, shorter cables could use less spacer 502 than longer cables for a given amount of noise picked up in the cables.

The specific distance required to get the noise level reduced is dependent upon: 1) the length of the cable, 2) the physical layout of the conductors, and 3) the level of low frequency noise. During one test on a 20-foot cable run with four twisted cable pairs #38 AWG, a spacer 500 of 1" significantly reduced the noise (30 dB less) picked up by the cables.

One preferred embodiment of the present invention uses small, equally sized conductors, twisted together. These conductors are separated from the car's chassis or noisy circuits or noisy leads by a non-conductive (insulating) material. The separation (distance) causes the changing electromagnetic field (noise) experienced by the small conductors to be significantly less. The energy falls off as the distance from the source increases. The conductors are closely spaced to reduce the loop area and therefore the inductive "pick-up" of the cables.

Another embodiment of the present invention uses spacers to move the sensitive signal wires away from the source(s) of EMI. Rather than spacing the conductors apart, the design in one embodiment maintains close contact between insulated conductors, and the conductors are slightly twisted together to minimize noise. Only enough dielectric between the small, twisted conductors is needed to provide electrical insulation for a low frequency signal (typically under 100,000 Hz and under 70 volts).

Figure 16:
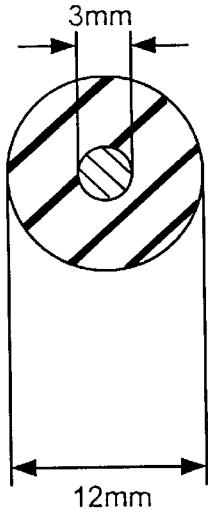
FIGS. 16 and 17 depict the ratio of diameters of conductor to spacer.
Figure 17:
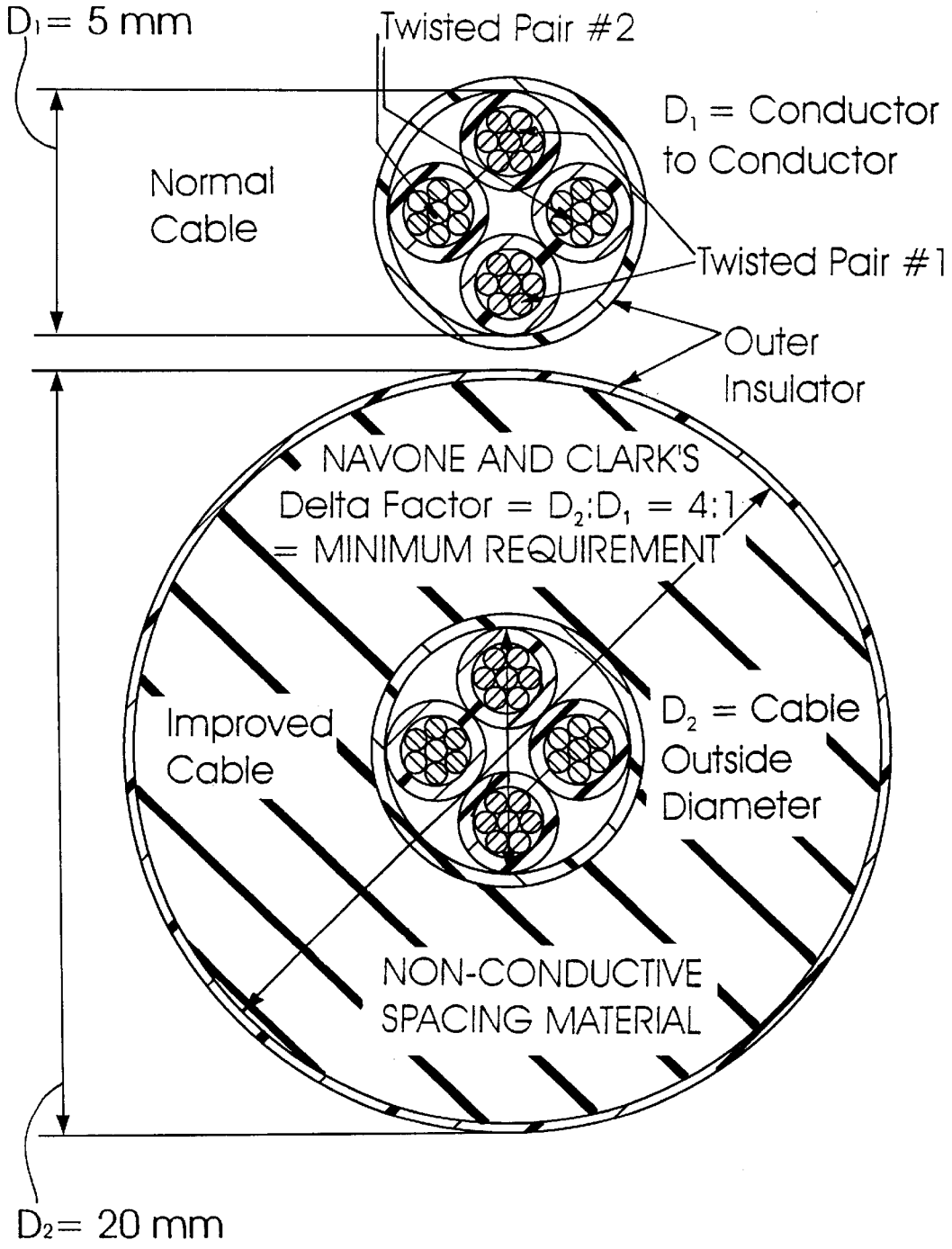

In another preferred embodiment tiny twisted pairs of conductors are used that are suspended a distance away from the car's chassis by a non-magnetic material. In this preferred embodiment, the preferred specification is for a ratio of diameters about 1:4. This means that if the central conductors are 3 mm in diameter, the diameter of the surrounding non-magnetic, insulating material would be at least about 12 mm, see FIGS. 16 and 17.

Some pre-amp signal cables use thinly insulated small wires and twist them tightly together to produce a total diameter of about 2 mm. In one embodiment of the present invention insulation is disposed until the outside diameter of this tiny 2 mm cable is a minimum of about 8 mm. (25.4 mm=1 inch).

Figure 18:
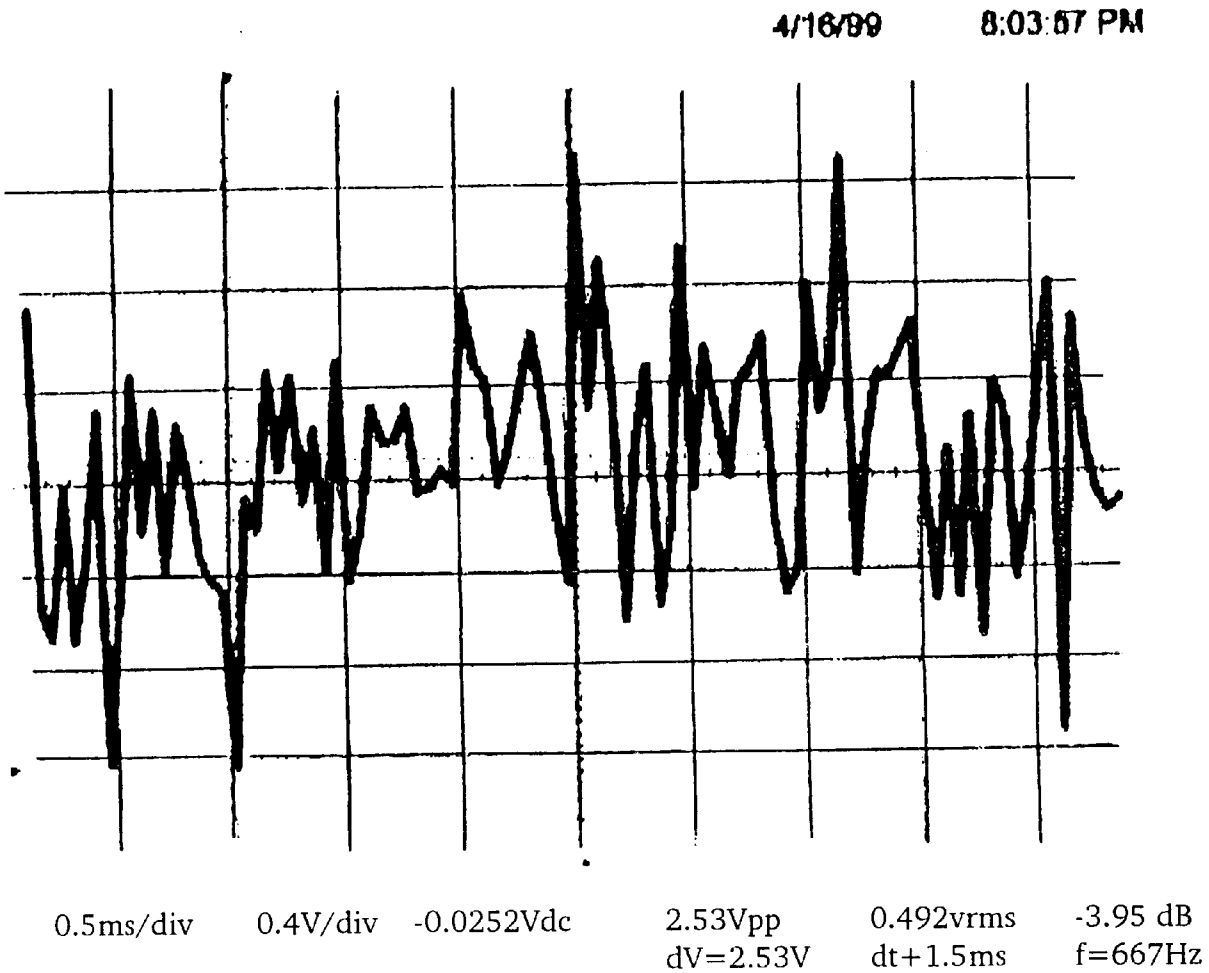
FIGS. 18–20 graphically illustrate the effectiveness of the spacers of the present invention.
Figure 19:
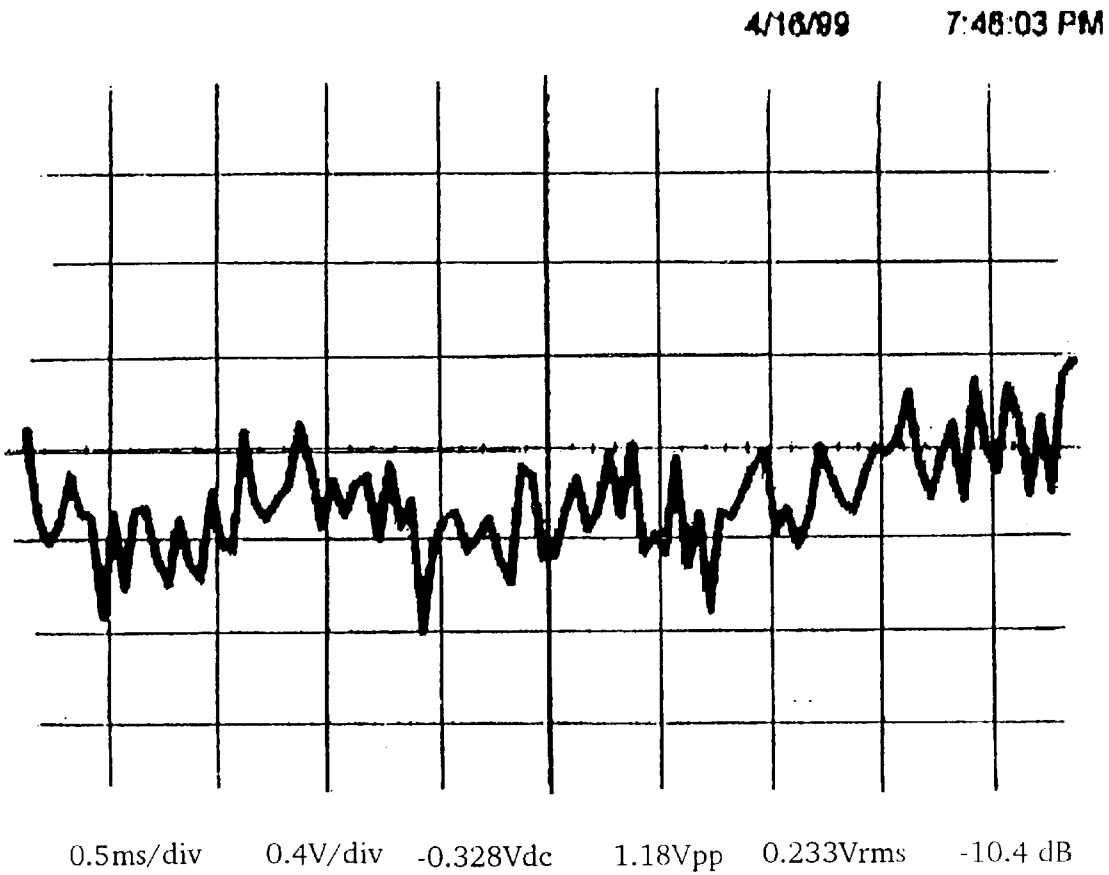
Figure 20:
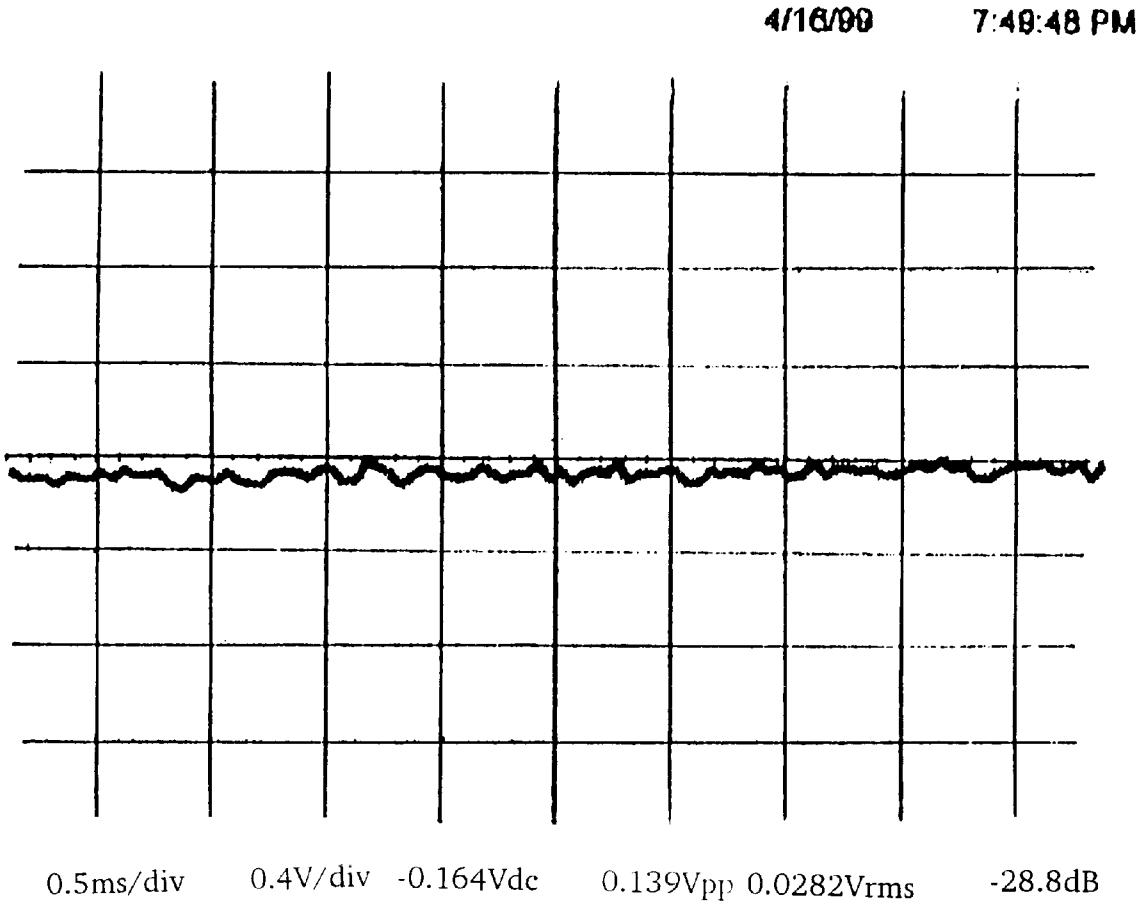

FIGS. 18, 19 and 20, show variation of inductive noise in relationship to the spacer.

FIG. 18 shows the inductive noise picked up in a test section of small twisted pair signal cable with $D_2$=2 mm=>−3.95 dB. $D_2$ in this measurement was 4 mm. $D_2$:$D_2$=2:1 and does not meet the preferred minimum requirement.

FIG. 19 shows the noise picked up in the same cable section with $D_2$=8 mm. This meets the preferred minimum requirement for the present invention. The noise level has now dropped down to −10.40 dB. The only difference in this test is that the conductors have been distanced from the audio frequency noise. The result is a 6 dB reduction in noise. This equates to 50% reduction in inductive noise.

FIG. 20 shows the noise picked up in the same cable section with $D_2$=14 mm. This outside dimension leads to Delta Factor 14:2 or 7:1. Notice that the noise level has dropped to −28.8 dB=> a tremendous drop of 24.85 dB in the level of noise picked up in the cable. This is less than $1/100^{th}$ the noise in the original cable.

The prior art does not minimize the distance between the twisted-paired conductors and maximize the distance between the conductors and the extremities of the insulation. The prior art teaches separating conductors with insulation to maintain a constant capacitance or dielectric between conductors. Separating the conductors would increase the loop area and increase the low frequency inductive noise picked up in the cables.

Other features and advantages of the present invention will become apparent from the following description of the invention which refers to the accompanying drawings.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A cable for conducting electronic signals in proximity to a source of electromagnetic interference, the cable comprising:

at least one longitudinally extending conductive wire having a diameter and an outer surface; and a spacing member substantially coaxially disposed around said at least one wire and having a diameter and an outer surface and having no electrostatic or EMI shielding constituent, wherein a radial distance between the outer surface of the wire and the outer surface of the spacing member has a magnitude such that inductive pick up in the wire from the source of electromagnetic interference is below about −4 db.

2. The cable of claim 1, wherein the spacing member is an electrical insulator.

3. The cable of claim 2, wherein the spacing member includes a material taken from the group consisting of plastic, fiberglass, glass, wood, paper, cloth, gas, air, fluids, and water.

4. The cable of claim 1, wherein the at least one wire includes a plurality of wires.

5. The cable of claim 4, wherein the plurality of wires are in a twisted configuration.

6. The cable of claim 4, wherein the plurality of wires are in twisted pair configurations.

7. The cable of claim 1, wherein the spacing member is a compressible material.

8. A cable for conducting electronic signals in proximity to a source of electromagnetic interference, the cable comprising:

at least one longitudinally extending conductive wire having a diameter and an outer surface; and a spacing member substantially coaxially disposed around the at least one wire and having a diameter and an outer surface and having no electrostatic or EMI shielding constituent, wherein a ratio of the diameter of the spacing member and the wire is of a sufficient magnitude such that inductive pick up in the wire from the source of electromagnetic interference is below about −4 db.

9. The cable of claim 8, wherein the spacing member is an electrical insulator.

10. The cable of claim 8, wherein the spacing member is a compressible material.

11. The cable of claim 8 where said spacing member comprises foam rubber.

12. A cable for conducting electronic signals in proximity to a source of electromagnetic interference, the cable comprising:

at least one longitudinally extending conductive wire having a diameter and an outer surface; and a spacing member substantially coaxially disposed around the at least one wire and having a diameter and an outer surface and having no electrostatic or EMI shielding constituent, wherein a ratio of the diameters of the spacing member and the wire is about 4 to 1.

13. The cable of claim 12, wherein the spacing member is an electrical insulator.

14. The cable of claim 12, wherein the spacing member is a compressible material.

15. The cable of claim 12 where said spacing member comprises foam rubber.

16. A cable for conducting electronic signals in proximity to a source of electromagnetic interference, the cable comprising:

at least one longitudinally extending conductive wire having a diameter and an outer surface; and a spacing member substantially coaxially disposed around the at least one wire and having a diameter and an outer surface and having no electrostatic or EMI shielding constituent, wherein a ratio of the diameters of the spacing member and the wire is about 2 to 1.

17. The cable of claim 16, wherein the spacing member is an electrical insulator.

18. The cable of claim 16, wherein the spacing member is a compressible material.

* * * * *